428-408 SR
3/24/87 XR 4,651,445

United States Patent [19]

Hannibal

[11] Patent Number: 4,651,445

[45] Date of Patent: Mar. 24, 1987

[54] COMPOSITE SOLE FOR A SHOE

[76] Inventor: Alan J. Hannibal, 5032 Deerfield Dr., Fairview, Pa. 16415

[21] Appl. No.: 771,792

[22] Filed: Sep. 3, 1985

[51] Int. Cl.[4] ..... A43B 13/00; A43B 13/38

[52] U.S. Cl. ..... 36/103; 36/44; 36/76 C; 128/581; 128/595; 428/408

[58] Field of Search ..... 36/44, 43, 76 C, 30 R, 36/103; 12/146 M; 428/902, 408; 128/581, 586, 595

[56] References Cited

U.S. PATENT DOCUMENTS

| | | | |
|---|---|---|---|
| 1,890,910 | 12/1932 | Marshall | 36/44 X |
| 2,330,398 | 9/1943 | Vass . | |
| 2,599,317 | 6/1952 | Brady | 36/44 |
| 2,644,250 | 7/1953 | Ciaio . | |
| 2,653,396 | 9/1953 | Gottlieb et al. . | |
| 3,530,489 | 9/1970 | Appleton | 36/44 |
| 4,023,801 | 5/1977 | Van Auken | 428/408 X |
| 4,101,704 | 7/1978 | Hiles | 36/44 UX |
| 4,231,169 | 11/1980 | Toyama et al. . | |
| 4,439,934 | 4/1984 | Brown . | |
| 4,520,581 | 6/1985 | Irwin et al. | 36/44 X |
| 4,524,529 | 6/1985 | Schaefer | 36/44 X |
| 4,610,101 | 9/1986 | Brown | 36/44 |
| 4,611,413 | 9/1986 | Brown | 36/44 |
| 4,612,713 | 9/1986 | Brown | 36/44 |

FOREIGN PATENT DOCUMENTS

| | | | |
|---|---|---|---|
| 67657 | 4/1951 | Netherlands | 36/44 |

OTHER PUBLICATIONS

A. J. Hannibal, B. P. Gupta, J. A. Avila, C. H. Parr-"-Flexible Matrix Composites Applied to Bearingless Rotor Systems", Jan. 1985 Journal of the American Helicopter Society, vol. 30, Number 1.

*Primary Examiner*—James Kee Chi
*Attorney, Agent, or Firm*—James W. Wright

[57] ABSTRACT

A sole for a shoe is described formed from a composite material. The composite material includes a plurality of plies with each ply having a plurality of high modulus, preferably unidirectional, fibers oriented at an angle from about ±40° to about ±90° relative to the longitudinal axis of the sole. The fibers are embedded within and bonded together by a low modulus resilient matrix. The sole is highly compliant about the forward roll axis of the sole while providing for lateral stability.

21 Claims, 8 Drawing Figures

COMPOSITE SOLE FOR A SHOE

BACKGROUND OF THE INVENTION

This invention relates to a sole for shoes, and in particular, to a sole for sports shoes or as an orthotic insert to improve the lateral stability of the shoe while being compliant in response to the forward rolling action of the foot.

For purposes of illustrating the present invention, reference will be made to the running shoe and the requirements of the running shoe. By way of introduction, the normal gait cycle of a runner's foot should be briefly described to better understand the environment in which the present invention is applicable. Before heel strike, the foot is disposed at an upward angle relative to the ground and rotated or twisted outward, commonly referred to as supination. The initial part of the foot to impact on foot fall is the outward portion of the heel. Upon heel strike or impact, the ankle, knee and hip collectively cushion the shock. There is an inward rolling of the foot, a process called pronation. Pronation is the body's way of partially absorbing the vertical impact force of the foot fall. Excessive pronation, whether caused by lateral instability in the shoe or otherwise, increases the likelihood of injury. The degree of pronation also varies from runner to runner. From the heel strike, through pronation, the impact forces and body weight are transferred to the ball or mid portion of the foot. In the lift-off, the toes propel the foot off the ground and the foot twists outward as the knee and hip extend forward into the next gait cycle. During the gait cycle, while the foot is on the ground, the foot goes through a forward rolling action—first heel, then ball and finally toes.

Running shoes are typically constructed with a mid sole that provides impact cushioning. While impact cushioning reduces vertical shock, such cushioning normally contributes to lateral instability which results in more severe and undesired pronation. Lateral stability is desired in many different forms of shoes, particularly sport shoes, with the shoe being compliant to the forward rolling action of the foot.

DESCRIPTION OF PRIOR ART

In recognition of the need for improved lateral stability in shoes, extensive prior art has been directed to the construction of the sole portion or the provision of a lateral counter or reinforcement to the side of the heel. Lateral counters or reinforcements typically take on the form of a rigid or semi-rigid vertically extending brace in the heel region of the shoe that restricts lateral movement of the heel. Examples of lateral counters of this type are illustrated in U.S. Pat. Nos. 3,425,075; 4,255,877; 4,316,334; and 4,459,765. Such counters do not distribute forces over a large area and do not counter in a direction in line and opposite to the load force. As a result, lateral counters tend to cause relative movement between the heel and the shoe which results in rubbing and blistering of the heel.

More effective and satisfactory lateral stability can be provided through proper construction of the sole. The sole can provide a resistant or reaction force more in line and opposite to the load force, distribute the load over a greater area, and operate throughout a greater part of the gait cycle. Examples of sole constructions having integrated or built-in lateral stabilizers are taught by U.S. Pat. Nos. 4,128,950 and 4,364,189. These prior art teachings are directed at reinforcement of a portion of the sole with a more rigid or firm material typically on the inner side of the longitudinal axis of the sole. Different materials and materials of different properties are used in preferred and discrete zones to stabilize the heel section. Such stiffening reduces cushioning features otherwise provided in the shoe. The compliance of the sole to forward rolling action is also reduced.

Another type sole construction is disclosed in U.S. Pat. No. 4,297,796 wherein the sole includes an open-mesh web of interwoven stretch-resistant strands disposed at oblique angles realtive to the longitudinal axis. The strands transmit forces in a three-dimensional manner so that a force is distributed rather than localized. While such a sole construction does distribute forces over a larger area, only minor improvement is provided to lateral stability.

Several sole constructions have heretofore utilized what is commonly referred to as composite material. Composite materials refer to filamentary material disposed and embedded in a matrix or binder material. Typically, the filamentary material takes on a prescribed versus random orientation. Advantageous properties of composite materials include strength-to-weight ratio, stiffness-to-weight ratio, fracture and fatigue resistance, design flexibility and formability. The desired filamentary materials typically have a relatively high modulus of elasticity such as that of glass, carbon, aramid and boron. The matrix is typically a rigid thermosetting plastic such as an epoxy or polyester which have low elongation to failure in the range of 3 to 5 percent. The composite material advantageously uses the high modulus properties of the filamentary material. The matrix serves as a binder for the filamentary material.

Composite materials of the foregoing type have been suggested for use in the soles of shoes. Reference is made to U.S. Pat. Nos. 2,330,398; 2,644,250; 2,653,396; 4,231,169; and 4,439,934. These prior art soles are lightweight, formed to conform to the bottom of the foot and provide positive reinforcement for the foot with particular attention to the arch. The composite material, while being rigid, is sufficiently thin to retain some flexibility. The rigidity of the composite material, however, significantly interferes with the forward rolling action of the foot. In these teachings the sole customarily terminates at the mid-portion of the foot to minimize the extent of interference with the forward rolling action of the foot. The composite material has been typically used in soles as a substitute for metals and plastics.

SUMMARY AND OBJECTS OF THE INVENTION

A sole for a shoe is provided having good lateral stability while being compliant to the forward rolling action of the foot. The sole is fabricated from a filamentary composite material having a resilient matrix. The fibers are of high tensile modulus and are oriented at an angle from about ±40° to about ±90° relative to the longitudinal axis of the sole. The fibers are embedded within and bonded together by a low modulus matrix material preferably having a high elongation to failure. The sole may be co-extensive with the lower portion of a shoe with which it is utilized. For shoes having a shock-absorbing or cushioning mid sole, the sole of the present invention is preferably located between the cushioning mid sole and the upper portion of the shoe.

The angle of orientation of the filamentary material is critical to the maintenance of low resistance or compliance to forward roll of the sole while providing for good lateral stability. At angles of ±40° to ±90° relative to the longitudinal axis of the sole, the filamentary orientation has its least adverse impact on the compliance of the sole to the forward rolling action of the foot. At the same time, the orientation of the fibers to the lateral axis is from about 0° to about ±50°. Within this range of angles of orientation of the filamentary material relative to the lateral axis, a broad range of bending stiffness can be obtained. Also, within this range of orientation of the filamentary material, the shear modulus or resistance to rotation or twist about the longitudinal axis can be varied between a minimum shear modulus at ±90° to a maximum shear modulus at ±45°. When a rigid matrix material is used, these unique and selectable properties are not obtainable.

In addition, the low modulus matrix allows the sole to readily conform longitudinally to the contour of the foot in response to loading. This results in distribution of forces over a broader area than would otherwise be obtained.

Accordingly, it is a primary object of the present invention to provide a novel sole for shoes which is compliant to forward roll of the foot while providing for lateral stability.

It is a further object of the present invention to provide a sole which provides for lateral stability when used in conjunction with a shock absorbing or cushioning mid sole.

It is another object of the present invention to provide a sole which is rigid or compliant in select predetermined axes.

A still further object of the present invention is to provide a sole construction that conforms to the contour of the foot longitudinally to more uniformly distribute forces.

These and other objects will become evident from the following detailed description.

DETAILED DESCRIPTION OF THE INVENTION

Figure 1:
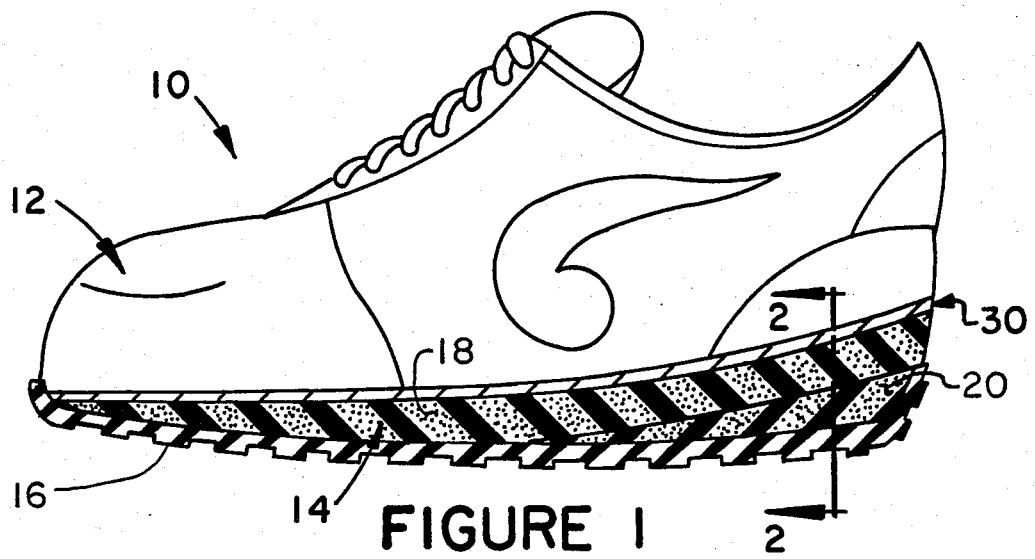
FIG. 1 is a side elevation view of a sport shoe with portions in section incorporating a sole of the present invention.
Figure 2:
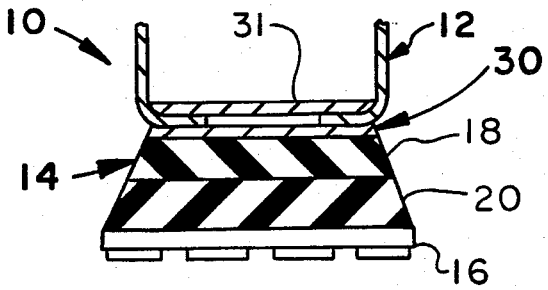
FIG. 2 is a sectional view taken along the line 2—2 of FIG. 1.

With reference to the drawings, there is shown in FIGS. 1 and 2 a sports shoe 10 having a sole constructed in accordance with the present invention. Except with respect to the inner sole, the shoe 10 is of conventional design for a running shoe.

Briefly, the shoe 10 includes an open upper portion 12 which typically is formed of leather and synthetic fabric to provide good strength, resilience and breathability. The foot of the wearer is received and secured within the upper portion 12 with the bottom of the foot resting on a lower sole portion 14. The sole portion 14 extends the length and width of the foot and is joined at its edges to the upper portion 12.

The sole portion 14 includes an outer sole layer 16 for contact with the ground and is formed of wear-resistant material. Cleats, waffles or the like designs are provided on the ground contact surface of the outer sole 16 for traction.

A mid sole 18 of resilient lightweight cushioning material is provided between the outer sole 16 and upper poriton 12 coextensive therewith. The thickness of the mid sole 18 tapers to a smaller thickness toward the mid foot and toe region. A heel wedge or lift 20 is preferably provided between the outer sole 16 and mid sole 18 beneath the heel and tapers toward the arch or instep where it terminates. The heel lift 20 is typically formed of the same material as the mid sole 18. The mid sole 18 together with the heel lift 20 provide cushioning for reducing the vertical impact of heel strike on the body structure. The heel lift 20 allows for added cushioning in the heel region which is the area receiving the initial and greatest impact force. The mid sole 18 and heel lift 20 are customarily made of low density, resilient synthetic plastic foam materials of polyurethane, polyethylene or polyethylene vinyl acetate.

The sole construction of the present invention is utilized in shoe 10 as a substantially planar inner sole 30 forming a part of the lower sole portion 14. Inner sole 30 is located between the mid sole 18 and upper portion 12. A liner 31 may be provided over the inner sole 30 as a pad for the foot. The inner sole 30 in the present embodiment is coextensive with the upper portion 12 and mid sole 18 and thus supports the foot throughout its length and width. While the inner sole 30 is said to be substantially planar, it may be shaped to better conform to and support the foot including the arch area.

Figure 3:
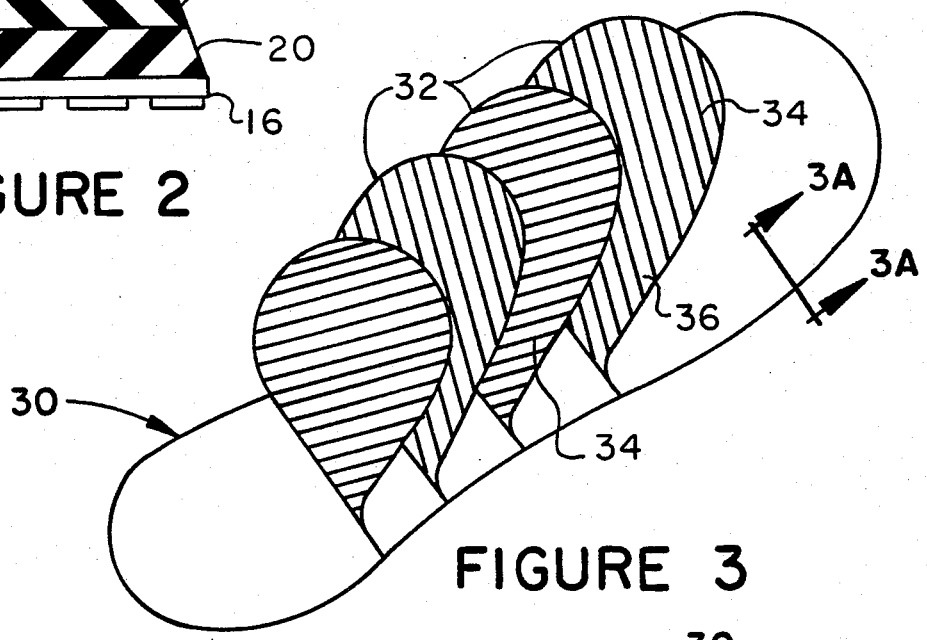
FIG. 3 illustrates in perspective the sole of the present invention with plies of composite material rolled back showing the multi-ply form of the sole.
Figure 4:
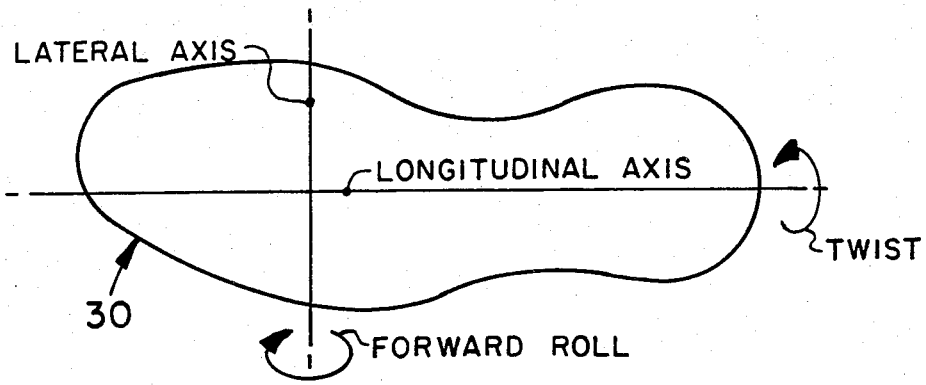
FIG. 4 is a top plan view of a sole of the present invention illustrating the axes of the sole.

The construction of inner sole 30 is perhaps best illustrated by FIGS. 3 and 4. Prior to describing the inner sole 30, the axes of the inner sole 30 need to be defined. For this purpose, reference is made to FIG. 4 which shows in top plan view the inner sole 30. The inner sole 30 is elongate, substantially planar, and takes on the general outline or profile of the bottom of the foot. The elongate axis of the inner sole 30 will be referred to as the longitudinal axis and axes normal to and along the longitudinal axis and generally in the plane of the sole 30 will be referred to as the lateral axes. As will be recalled from the earlier description of the gait cycle of a runner, the foot goes through a forward roll action. This forward roll is rotation about lateral axes which progressively takes place about lateral axes moving from the heel forward during the gait cycle. In addition, the foot tends to turn inward and/or outward about the longitudinal axis during the gait cycle. Such movement will be referred to as lateral roll or twist.

The inner sole 30 comprises a plurality of superimposed laminates or plies 32 of filamentary composite material having a resilient matrix. As illustrated in FIG. 3, each ply 32 is substantially planar and includes a plurality of elongate parallel unidirectional filaments 34. The fibers 34 should be substantially non-twisted to allow full benefit from their mechanical properties. It is preferable to use unidirectional fibers rather than woven fibers for the same reason.

Filaments for use in the present invention have a relatively high tensile modulus of elasticity, preferably at least about $7\times10^3$ MPa (Mega Pascal) along their elongate axis. Examples of fibers which can be used include glass fibers, carbon or graphite fibers, silicon carbide fibers, boron fibers, aramid fibers, nylon fibers and polyester fibers. Combinations of fibers may also be used. Glass fibers have a tensile modulus of elasticity of about $7\times10^4$ MPa and are preferred in the present invention primarily because of their high modulus properties relative to cost.

The fibers 34 are embedded in and bonded together to form the ply by a resilient matrix 36. The matrix 36 serves as a binder for the fibers and should have a modulus of elasticity less than about $7\times10^2$ MPa at 100 percent strain. The matrix will preferably be an elastomeric material such as urethane. Other low modulus matrix materials may be used including plasticized polyvinyl chloride. Such matrix materials typically have an elongation to failure in excess of 100 percent.

Elastomers have good fatigue properties and a modulus of elasticity between about 3.5 and 35 MPa. Urethane is preferred because of its modulus, elongation and fatigue properties and its ability to be worked in a liquid form during manufacture.

Composite materials utilizing a flexible or resilient matrix of the foregoing type have been described in an article entitled "Flexible Matrix Composites Applied to Bearingless Rotor Systems", published in the January 1985 issue of the Journal of the American Helicopter Society.

Figure 5:
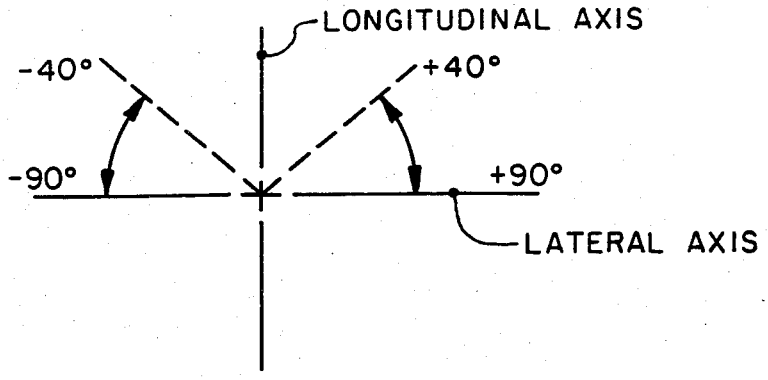
FIG. 5 illustrates orientation ranges of fibers relative to axes of the sole.

In the case of shoe 10, the angle of orientation of the fibers 34 within the resilient matrix 36 relative to the longitudinal axis of the shoe 10 or inner sole 30 is critical. FIG. 5 shows the desired angles of orientation of the fibers 34. The desired range of orientation is between about 40° and 90°. This may be clockwise relative to the longitudinal axis between about +40° and +90° or counter clockwise relative to the longitudinal axis between about −40° and −90°. Thus, the desired range is denoted from about ±40° to about ±90°.

Figure 3A:
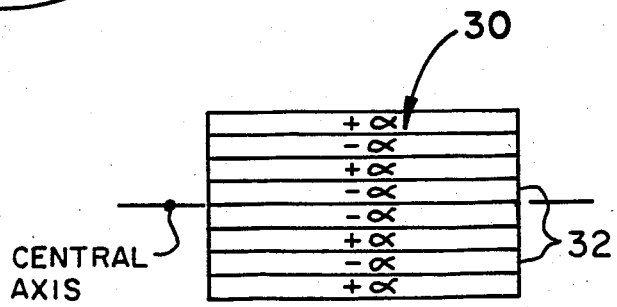
FIG. 3*a* is a sectional view along the line 3*a*–3*a* of FIG. 3.

The inner sole 30 is substantially planar and comprises a plurality of laminates or ply 32. As shown in FIG. 3*a* the ply 32 are evenly disposed on opposite sides of a central axis. For every ply 32 on one side of the central axis there is a ply 32 on the opposite side of the central axis, thus an even number of ply. The complement of plies 32 of sole 30 are both balanced and symmetric. For every ply having fibers oriented at a positive angle of $+\alpha$ (a positive ply) there is a corresponding ply having fibers oriented at an equal but negative angle of $-\alpha$ (a negative ply). Provided the ply are otherwise the same, this makes the complement of plies 32 balanced. In inner sole 30, for each ply on one side of the central axis there is a corresponding ply on the other side of the central axis with fibers oriented at the same angle and of the same sign and at the same spacing from the central axis. The combination of these features makes the complement of plies 32 symmetric. In a symmetric system, one side of the central axis is the mirror image of the other side. A balanced and symmetric system is decoupled and deflection relative to one axis does not cause deflection relative to another axis.

In the embodiment illustrated in FIG. 3*a*, the angle of fiber orientation for each ply is the same except for the sign of the angle. This need not be the case and still have a balanced and symmetric system. For instance, in FIG. 3*a* the outermost two plies on opposite sides of the central axis need not have the same angle $\alpha$ of fiber orientation as that of the other plies. In addition, plies of different material may be used. As an example, the outermost two plies on opposite sides of the central axis could utilize a higher modulus fiber such as carbon with the other plies utilizing a lower modulus fiber such as glass. Such a system would allow for greater resistance to bending laterally and twist than would otherwise be obtained with the lower modulus fibers in the outer layers.

The inner sole 30 of the present invention can be produced using conventional methods for fabricating sheets of composite materials. The primary exception is that a low modulus resilient matrix material is used and the angle of orientation of the fibers take on an orientation within the described range. In the case where urethane is used as the resilient matrix, the fibers are preferably coated with liquid urethane and laid up into the desired number of plies prior to curing of the urethane. The inner sole 30 is cut from cured stock material of the composite material. When the inner sole 30 is integrated into the lower sole 14, it is desired that a low modulus adhesive be used for this purpose. The adhesive may be the same material as the resilient matrix 36 of the composite material.

Figure 6:
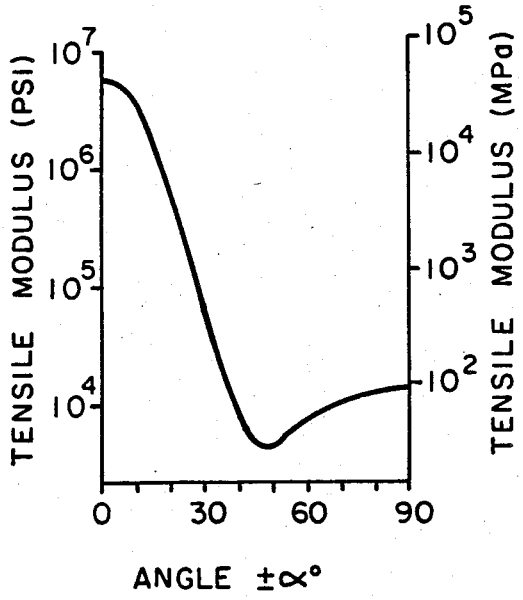
FIG. 6 is a diagrammatical view illustrating the tensile modulus of the composite material along the longitudinal axis as a function of fiber orientation.
Figure 7:
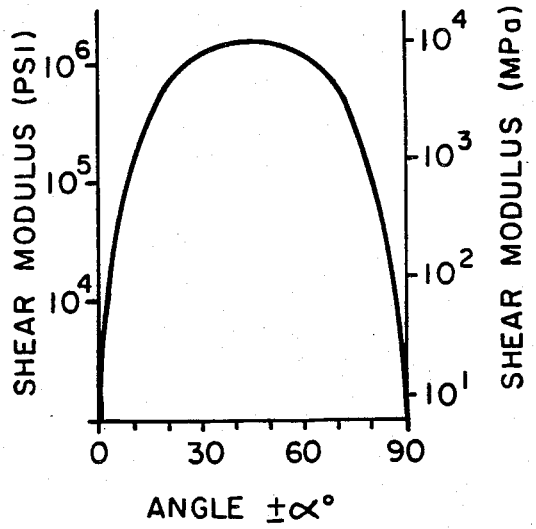
FIG. 7 is a diagrammatical view illustrating the shear modulus of the composite material about the longitudinal axis as a function of fiber orientation.

The application of composite materials utilizing a resilient matrix in the sole of a shoe allows for unique and desirble mechanical properties to be provided to inner sole 30. Reference is made to FIGS. 6 and 7 wherein certain mechanical properties of sole 30 are illustrated as a function of the angle of orientation of the fibers. The composite material illustrated by these Figures are for unidirectional fibers of glass and a matrix of urethane. FIG. 6 shows the typical relation of the tensile modulus of the inner sole material to the angle, $\alpha$, of orientation of the fibers relative to the longitudinal axis of the sole. The tensile modulus is expressed both in terms of pounds per square inch (psi) and Mega Pascals (MPa). As expected, the tensile modulus at $\alpha$ of 0° is the highest. As the angle increases to about ±40° the tensile modulus decreases rapidly. At about ±40°, the modulus begins to stabilize and after going through a minimum increases only slightly as the angle increases from about ±40° to ±90°. In this region the tensile modulus is low and generally relective of the modulus of the resilient matrix 36 independent of the fiber type. The angle range from about ±40° to ±90° becomes the preferred angle of orientation of the fibers. Within this orientation range, the sole will have low resistance to forward roll. At the same time, a broad range of moduli of elasticity relative to the lateral axis and resistance to twist about the longitudinal axis is possible depending upon the angle of fiber orientation selected.

With a given angle of fiber orientation relative to the longitudinal axis of inner sole 30, the angle of fiber orientation relative to the lateral axis will be the complementary angle to 90°. For complementary angles from 0° to about ±30°, the tensile modulus of elasticity along the lateral axis is an order of magnitude greater than the modulus along the longitudinal axis. Thus, high resistance to bending laterally can be achieved while maintaining low resistance to forward roll.

The resistance of the sole 30 to twist or rotation about the longitudinal axis is determied by the shear modulus. FIG. 7 illustrates the shear modulus as a function of angle orientation of the fibers relative to the longitudinal axis. The shear modulus is expressed both in terms of psi and MPa. Within the angle range of about ±45° to ±90°, the shear modulus can be varied over a broad range. This allows the resistance to twist or roll about the longitudinal axis to be selected to best fit the conditions in which it will be used.

In the case of a running shoe, it is preferred that the angle of orientation of the fibers relative to the longitudinal axis be in the range from about ±60° to about ±90°. Within this range, the sole will be compliant to forward roll along the longitudinal axis, have good resistance to bending laterally to the longitudinal axis and be low to moderately resistant to twist about the longitudinal axis. In the case of a cross country ski boot, it is desirable to use an angle of orientation of the fibers relative to the longitudinal axis from about ÷40° to about ±60°. Such a sole will be about equally compliant to forward roll along the longitudinal axis and to bending laterally but will be highly resistant to twist about the longitudinal axis. When it is desired to maximize the resistance to twist, the bending stiffness laterally is reduced.

The fatigue life of composite materials of the type used in the present invention has been found to be best for angles of orientation between about ±40° and ±90° with about ±70° being the best. The fiber volume fraction should be between about 30 percent and 60 percent.

From the foregoing description it will be recognized that a sole formed from a filamentary composite material utilizing a resilient matrix allows preferred degrees of softness and stiffness to be provided along and about predetermined axes as a function of the angle of orientation of the fibers relative to the predetermined axes.

In shoe 10, the inner sole 30 has been constructed to have a low resistance to the forward roll of the foot. This is desired in most if not all shoe applications. The inner sole 30 may be resistant to bending laterally and twisting about the longitudinal axis of the shoe. These latter properties provide desired lateral stability to the foot. As related to the gait cycle, the initial part of the foot to impact on foot fall is the outward portion of the heel. A sole having lateral stability as that afforded by the present invention will cause the impact force to be distributed over the entire lateral heel portion of the lower sole and minimize localized flexure. This lateral stability also resists pronation or the inward rolling of the foot that follows. As the foot completes the cycle and the toes push off, the inner sole 30 creates only nominal resistance to the forward roll of the foot. In the case of running shoe 10, the present invention allows for a shoe having good vertical shock absorbing characteristics from the mid sole 18 and heel lift 20 while having good lateral stability without undue added resistance to the forward roll action of the shoe.

While the invention has been described as an inner sole forming an integral part of a shoe, it will be apparent that such a sole can be provided as a separate insert for a shoe. It will also be recognized that the sole construction of the present invention has utility in conjunction with shoes other than running shoes for both preventing foot, leg and knee injuries and for correcting certain abnormalities.

The present invention has been described wherein the plies or laminates of composite material are laid up in a balanced and/or symmetric form. Some applications may require or be best suited for a non-balanced and/or non-symmetric system. In those cases, deflection of the sole about one axis will cause deflection about another axis. This is referred to as the coupling effect. It is contemplated that the coupling effect can be used advantageously in many shoe applications. For example, if more positive plies than negative plies having the same angle of fiber orientation are used to form the inner sole, the forward roll of the foot in the gait cycle causes the inner sole to twist clockwise about the longitudinal axis. A predominantly positive ply construction could be advantageously used in the sole of a shoe for the right foot to resist the inward roll motion or pronation. The reverse would be true where more negative plies than positive plies are used. Thus, a predominantly negative ply construction could be advantageously used in the sole of a shoe for the left foot to resist the inward roll motion or pronation.

Although preferred embodiments of the invention have been specifically described and shown, it is to be understood that this was for purposes of illustration only, and not for purposes of limitation, the scope of the invention being in accordance with the hereinafter presented claims.

What is claimed is:

1. In a shoe including an upper portion and a lower sole portion joined to the upper portion, the improvement comprising said lower sole portion including an elongate substantially planar inner sole formed from a plurality of plies of composite material, each ply of composite material including a plurality of elongate fibers disposed and oriented in the plane of said inner sole at an angle from about ±40° to about ±90° relative to the longitudinal axis of said inner sole, said fibers being embedded within and bonded together by a resilient matrix, said fibers having a modulus of elasticity of at least about $7\times10^3$ MPa along their elongate axis and said resilient matrix having a modulus of elasticity less than about $7\times10^2$ MPa.

2. A shoe in claim 1, wherein said fibers are unidirectional.

3. A shoe in claim 1, wherein said resilient matrix is an elastomer and has a modulus of elasticity from about 3.5 to about 35 MPa.

4. A shoe in claim 2, wherein said resilient matrix is a urethane elastomer.

5. A shoe in claim 1, wherein said fibers are unidirectional fibers of glass and said resilient matrix is urethane elastomer.

6. A shoe in claim 1, wherein said fibers are oriented from about ±60° to about ±80° relative to the longitudinal axis of said inner sole.

7. A shoe in claim 1, wherein said inner sole is disposed in said lower sole portion adjacent to said upper portion.

8. A shoe in claim 1, wherein said lower sole portion includes a shock-absorbing mid sole and wherein said inner sole is disposed between said mid sole and said upper portion.

9. A shoe in claim 1, wherein said inner sole comprises an even number of plies of the composite material and for each ply there is a corresponding ply having fibers oriented at an equal but opposite angle relative to the longitudinal axis of said inner sole.

10. A shoe in claim 9, wherein for each ply there is a corresponding ply equally spaced on the opposite side of a central axis having fibers oriented at the same angle and of the same sign.

11. A shoe in claim 10, wherein the angle of fiber orientation for each ply is the same except for the sign of the angle.

12. A shoe in claim 9, wherein the fibers of outer plies have a modulus of elasticity greater than the fibers of other plies.

13. A shoe in claim 1, wherein the fiber volume fraction in said composite material is between about 30 and 60 percent.

14. In a shoe including an upper portion and a lower sole portion joined to the upper portion, the improvement comprising said lower sole portion including an elongate substantially planar inner sole formed from a plurality of plies of composite material, each ply of composite material including a plurality of elongate fibers unidirectionally disposed and oriented in the plane of said inner sole at an angle from about ±40° to about ±90° relative to the longitudinal axis of said inner sole, said fibers beig embedded within and bonded together by a resilient matrix, said fibers having a modulus of elasticity of at least about $7\times10^3$ MPa along their elongate axis and said resilient matrix having a modulus of elasticity less than $7\times10^2$ MPa.

15. A shoe in Claim 14, wherein the angle of fiber orientation for each ply is the same and wherein there are more plies of one sign than of the opposite sign.

16. A shoe in Claim 14, wherein the combination of plies are unbalanced and non-symmetric.

17. In a shoe including an upper portion and a shock-absorbing lower sole portion joined to the upper portion, said lower sole portion comprising an elongate mid sole formed from a resiliently deformable material coextensive with said upper portion, an elongate substantially planar inner sole coextensive with a major portion of said mid sole and disposed between said mid sole and the upper portion of said shoe, said inner sole being formed from a plurality of plies of composite material, each ply of composite material including a plurality of elongate fibers unidirectionally disposed and oriented in the plane of said inner sole at an angle from about ±40° to about ±90° relative to the longitudinal axis of said inner sole, said fibers being embedded within and bonded together by a resilient matrix, said fibers having a modulus of elasticity of at least about $7\times10^3$ MPa along their elongate axis and said resilient matrix having a modulus of elasticity less than $7\times10^2$ MPa.

18. A shoe in claim 17, wherein said fibers are oriented from about ±60° to about ±80° relative to the longtudinal axis of said inner sole and said resilient matrix is an elastomer having a modulus of elasticity less than 35 MPa.

19. Sole means for a shoe comprising an elongate substantially planar sole formed from a plurality of plies of composite material, each ply of composite material including a plurality of elongate fibers unidirectionally disposed and oriented in the plane of said inner sole at an angle from about ±40° to about ±90° relative to the longitudinal axis of said inner sole, said fibers being embedded within and bonded together by a resilient matrix, said fibers having a modulus of elasticity of at least about $7\times10^3$ MPa along their elongate axis and said resilient matrix having a modulus of elasticity less than about $7\times10^2$ MPa.

20. In a shoe including an upper portion and a lower sole portion joined to the upper portion, the improvement comprising said lower sole portion including an elongate substantially planar inner sole formed from a plurality of plies of composite material, each ply of composite material including a plurality of elongate fibers unidirectionally disposed and oriented in the plane of said inner sole at an angle from about ±60° to about ±90° relative to the longitudinal axis of said inner sole, said fibers being embedded within and bonded together by a resilient matrix, said fibers having a modulus of elasticity of at least about $7\times10^3$ MPa along their elongate axis and said resilient matrix having a modulus of elasticity less than about $7\times10^2$ MPa, said inner sole being compliant to forward roll along the longitudinal axis, resistant to bending laterally to the longitudinal axis and resistant to twist about the longitudinal axis.

21. In a shoe including an upper portion and a lower sole portion joined to the upper portion, the improvement comprising said lower sole portion including an elongate substantially planar inner sole formed from a plurality of plies of composite material, each ply of composite material including a plurality of elongate fibers unidirectionally disposed and oriented in the plane of said inner sole at an angle from about ±40° to about ±60° relative to the longitudinal axis of said inner sole, said fibers being embedded within and bonded together by a resilient matrix, said fibers having a modulus of elasticity of at least about $7\times10^3$ MPa along their elongate axis and said resilient matrix having a modulus of elasticity less than about $7\times10^2$ MPa, said inner sole being compliant to forward roll along the longitudinal axis, compliant to bending laterally to the longitudinal axis and highly resistant to twist about the longitudinal axis.

* * * * *